US005643371A

United States Patent [19]

Hanneman et al.

[11] Patent Number: 5,643,371

[45] Date of Patent: Jul. 1, 1997

[54] METHOD AND APPARATUS FOR CONTINUOUSLY CLADDING AND HOT WORKING CAST MATERIAL

[75] Inventors: Rodney E. Hanneman, Midlothian; Arthur L. Girard, Richmond, both of Va.

[73] Assignee: Reynolds Metals Company, Richmond, Va.

[21] Appl. No.: 481,576

[22] Filed: Jun. 7, 1995

[51] Int. Cl.[6] ..... B22D 11/06

[52] U.S. Cl. ..... 148/522; 148/523; 148/535; 148/437; 428/654

[58] Field of Search ..... 148/516, 522, 148/523, 527, 535, 691, 437; 164/419, 461; 428/650, 654

[56] References Cited

U.S. PATENT DOCUMENTS

| | | | |
|---|---|---|---|
| 2,022,571 | 11/1935 | Palm et al. | 164/461 |
| 2,128,943 | 9/1938 | Hudson | 164/461 |
| 2,301,902 | 11/1942 | Merle | 164/461 |
| 2,569,150 | 9/1951 | Brennan | 164/461 |
| 3,110,941 | 11/1963 | Fagg | 164/432 |
| 3,921,697 | 11/1975 | Petry | 164/453 |
| 4,086,952 | 5/1978 | Olsson | 164/479 |
| 4,224,978 | 9/1980 | Klein | 164/461 |
| 4,321,289 | 3/1982 | Bartsch | 164/461 |
| 4,614,224 | 9/1986 | Jeffrey et al. | 164/476 |
| 4,735,254 | 4/1988 | Itoyama et al. | 164/481 |
| 5,476,725 | 12/1995 | Papich et al. | 148/523 |

FOREIGN PATENT DOCUMENTS

| | | |
|---|---|---|
| 2 559 692 | 2/1984 | France . |
| 58-65549 | 4/1983 | Japan . |
| 58-119438 | 7/1983 | Japan . |
| WO85/01901 | 5/1985 | WIPO . |
| WO90/02008 | 3/1990 | WIPO . |

*Primary Examiner*—George Wyszomierski
*Attorney, Agent, or Firm*—Alan M. Biddison

[57] ABSTRACT

A method and apparatus for continuously cladding cast material includes simultaneously roll bonding a cladding liner stock to a material exiting a continuous casting apparatus. At the same time the liner stock is roll bonded to the cast material, the clad cast material is hot worked to form a clad product. A spray shield is positioned near the interface where the liner stock contacts the as cast material to prevent any impurities such as rolling lubricants from contaminating the bonding interface between the liner stock and the surface of the as cast material.

8 Claims, 1 Drawing Sheet

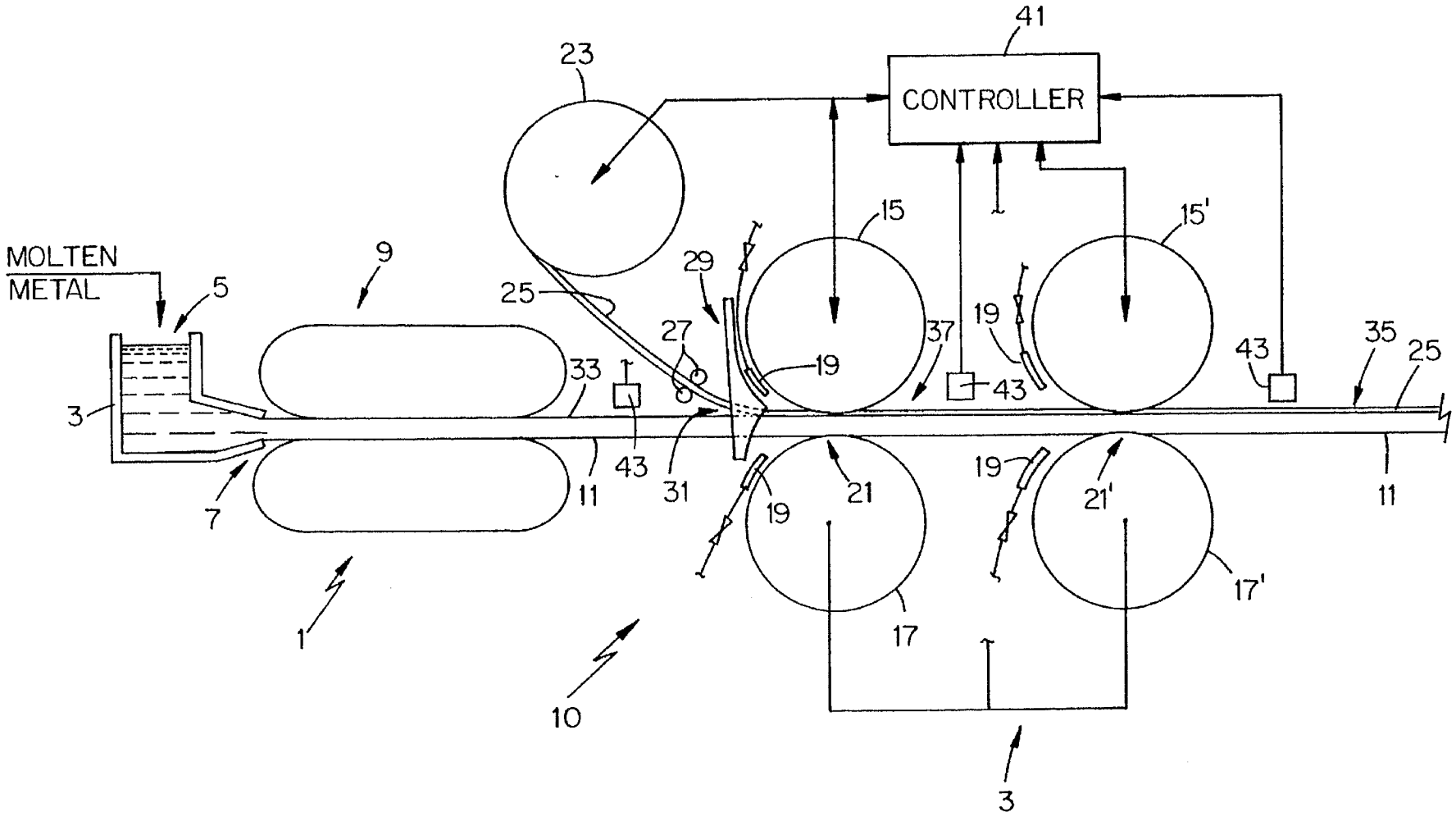
CONTROLLER
MOLTEN METAL
1
3
5
7
9
10
11
15
15'
17
17'
19
21
21'
23
25
27
29
31
33
35
37
41
43

METHOD AND APPARATUS FOR CONTINUOUSLY CLADDING AND HOT WORKING CAST MATERIAL

FIELD OF THE INVENTION

The present invention is directed to a method and apparatus for the continuous cladding and hot working of cast material and, in particular, a method and apparatus for hot rolling a continuously cast aluminum material as it exits a continuous caster, the hot rolling also roll bonding a liner stock to the as cast material.

BACKGROUND ART

In the prior art, it is well known to produce composite or clad materials, especially in the field of aluminum alloys. Clad aluminum alloys are especially desirable since the aluminum can be combined with another material serving a different purpose. For example, aluminum alloys are clad with a brazing material which is of a lower melting point to form a brazing sheet.

In one prior art technique, the brazing sheet is formed by first bonding the brazing material to a core material at an ingot or slab stage. The clad ingot must then be subsequently hot worked and cold worked to a final gauge. During the hot working, surface oxides are often formed, the surface oxides adversely affecting the brazing performance of the final product.

As an alternative, the prior art has produced clad aluminum materials by first casting and rolling a material to be used as the brazing component into thin gauge liner stock. The thin gauge liner stock is then bonded to an aluminum core strip material, the bonding typically occurring during continuous casting of the strip core material. This processing is also not without drawbacks since care must be taken to assure that the liquid core material adheres to the liner stock during the casting/bonding step.

In view of the disadvantages noted above with respect to prior art cladding techniques, a need has developed to provide improved methods and apparatus for cladding materials, particularly aluminum materials. In response to this need, the present invention provides a method and apparatus for producing a clad stock material which overcomes the disadvantages noted above by simultaneously hot working and roll bonding a continuously cast material and a liner stock to be clad thereon.

SUMMARY OF THE INVENTION

Accordingly, it is a first object of the present invention to provide a method and apparatus for the continuous cladding of a liner stock to a core material, preferably an aluminum core material.

Another object of the present invention is to provide a method and apparatus which offers significant improvements through the elimination of processing steps and reductions in energy costs when producing clad materials.

A further object of the present invention is to provide a method, apparatus and product which effectively clads a material to an as cast material by simultaneously hot working the liner stock and the as cast material immediately downstream of a casting operation.

Other objects and advantages of the present invention will become apparent as a description thereof proceeds.

In satisfaction of the foregoing objects and advantages, the present invention provides a method of continuously cladding a continuously cast material by first providing a liner stock material. The liner stock material is positioned adjacent a continuously cast form such as a slab at a hot working temperature. The cast form is at this temperature since it is exiting a casting station. The liner stock material is simultaneously clad or roll bonded to the cast form during hot working of the liner stock and the cast form to a select gauge.

The method is preferably practiced using a material that can be continuously cast using a block or belt caster. The material is preferably hot worked using a hot rolling mill. During hot rolling, it is preferred to shield the bonding interface between the surfaces of the liner stock and the as cast material to be bonded together from impurities such as lubricants used during the hot working step.

During simultaneous roll bonding and hot working, the hot working can be controlled to maintain synchronization between the casting step and the hot working step.

In another aspect of the invention, an apparatus is provided to clad and hot work a cast material. The apparatus includes a source of a liner stock strip material and a means for positioning the liner stock strip material on a cast form exiting a casting station at a hot working temperature.

Means are provided for simultaneously cladding the liner stock strip material to the cast form and hot working both the clad liner stock strip material and the cast form to a select gauge. Preferably, the hot working is performed using a hot rolling apparatus.

A shield is provided upstream of the hot working apparatus to prevent any impurities or other undesirable materials from entering the interface between liner stock strip material and bonding surface of the as cast material. In addition, a controller can be provided to synchronize the speeds of the casting apparatus and the hot working apparatus as well as to control operation of the hot working apparatus with respect to thicknesses of the as cast and clad and hot worked materials.

BRIEF DESCRIPTION OF THE DRAWINGS

Reference is now made to the sole drawing of the invention which is a schematic representation of the inventive apparatus for simultaneously cladding and hot working an as cast material.

DESCRIPTION OF THE PREFERRED EMBODIMENTS

With reference to the sole FIGURE of this application, the apparatus for cladding and hot working a continuously cast material is generally designated by the reference numeral 10 and is seen to include a continuous casting apparatus 1 in combination with a hot rolling apparatus 32.

The continuous casting apparatus 1 includes a tundish 3 having molten metal 5 therein. The molten metal 5 can be supplied from any conventional source such as a melting furnace or the like.

The tundish 3 terminates in a nozzle 7 which feeds the molten metal 5 into the caster 9. The caster 9 can be any known type of a caster that produces a slab or strip material 11 requiring further hot working. Preferred continuous casting apparatus include a block or belt caster. However, these preferred types are merely exemplary and other casting apparatus producing a product to be clad and hot worked can be utilized in accordance with the present invention.

Typically, the cast product 11 is about 0.7 inches thick. However, other cast thicknesses can be used by adjustment of the casting apparatus and/or knowing the final gauge of the product to be made.

The hot rolling apparatus 32 is positioned adjacent the continuous casting apparatus 1 so that the cast slab 11 can be effectively hot worked, i.e., reduced at a temperature above the cast slab's recrystallization temperature. If necessary, cooling and/or heating means can be provided downstream of the casting apparatus 9 to control the cast slab's temperature for hot working and cladding.

The hot rolling apparatus 32 is seen to include a two-high tandem hot rolling mill comprising a first set of work rolls 15 and 17 and a second set of work rolls 15' and 17'. Lubricating sprays 19 are positioned in the vicinity of the roll nips 21 and 21'.

The hot rolling apparatus 32 also includes a liner stock payoff reel 23 which stores a supply of liner stock 25 to be clad onto the cast slab 11. The liner stock 25 is guided and driven by the rolls 27 into the roll nip 21 so as to be synchronized with the movement of the cast slab 11 through the rolling mill 32. Of course, other means as are known in the art can be used to position the liner stock for mating with the cast slab 11 and entry into the roll nip 21. In another embodiment of the invention (not shown) a liner stock payoff reel, similar to reel 23, is positioned to feed liner stock 25 into the roll nip 21 from the bottom so that the cast slab 11 has stock applied no both its top and bottom surfaces. In addition, heating means (not shown) may be used to heat the stock 25 before it enters the roll nip 21.

In the first roll nip 21 adjacent the casting apparatus 1, the cast slab 11 is simultaneously roll bonded to the liner stock 25 and reduced in thickness as part of the hot rolling operation. The liner stock 25 also experiences a reduction in thickness. Preferably, the thickness of the liner stock 25 is between about 10% or less and about 15% or more of the thickness of the clad stock material 35. When two liner stocks are applied, the thickness of the liner stocks would be doubled.

Preferably, a spray shield 29 is positioned upstream of the roll nip 21 and lubricating sprays 19. The spray shield 29 shields the gap or interface 31 between the liner stock 25 and the top surface 33 of the cast slab. Maintaining the interface 31 lubricant free assures a complete and integral roll bond between the liner stock 25 and the cast slab surface 33. The presence of any rolling lubricant or other impurity in the interface 31 may cause blisters in the clad and hot worked product either at an intermediate gauge or at a final gauge.

The hot rolling apparatus 32 of the sole FIGURE schematically shows a tandem hot rolling mill which performs a two step hot reduction to the cast slab 1. The two stage rolling mill then produces a clad stock material 35 comprising the cast slab 11 and cladding 25, each reduced in thickness by the hot rolling.

An exemplary processing sequence for cladding and hot working an aluminum alloy will now be described. First, an aluminum alloy such as AA3003 or AA6951 is melted and transferred to the tundish 3. The aluminum alloy is continuously cast into a slab of thickness 0.7 inches with a width representative of known casting width.

A coil of liner stock such as AA4343 or AA4045 is positioned on the payoff reel 23 and is fed into the first roll nip 21 via the guiding and drive rollers 27. The liner stock is 0.070 inches in thickness.

The clad stock 37 exiting the first pair of work rolls 15 and 17 has an overall thickness of 0.40 inches. The clad stock 37 is further hot worked by the rolls 15' and 17' to an gauge of 0.25 inches thick. The hot rolled clad stock 35 can then be subjected to additional processing steps to form a clad material which can be used in a variety of applications, for example, as brazing sheet. Alternatively, if desired, the clad stock 35 can be used in the hot rolled state.

The thicknesses described above for the cast slab, liner stock and hot rolled clad stock are exemplary. Other cast slab thicknesses as well as hot rolled clad stock thicknesses representing a given percent reduction, e.g. 30 to 70% reduction, can be utilized to form the hot rolled clad stock. The various thicknesses will also depend on the materials being hot worked and clad.

Moreover, the tandem hot rolling apparatus 3 is merely representative of any means to hot work the as cast material. For example, four high hot rolling mills can be used rather than the two high mills depicted in the sole figure of this application. In addition, one or more than two rolling stands can be utilized to achieve a target percent hot reduction.

Referring again to the sole FIGURE, the hot rolling apparatus 32 can also include a controller 41 to control the rolling operation. The controller, in one aspect, can be responsive to the speed and thickness of the clad stock exiting the work rolls 15 and 17 and 15' and 17'. Sensors for detecting the speed and thickness of the cast or hot worked material are represented by the reference numeral 43. Since these sensors are conventional in the rolling arts, a further detailed description thereof is not deemed necessary for understanding of the invention. The sensors 43 provide information to the controller 41 as to the thickness of the sensed material and its speed. The controller 41 can then assist in controlling the rolling operation by adjusting rolling variables such as mill speed, roll pressure, etc.

The controller 41 also monitors the speed of the work rolls 15, 17, 15' and 17', the cast slab speed and the liner stock payoff speed. One of the controller's principal functions is to synchronize the feeding of the liner stock 25 with the speed of the cast slab 11 exiting the casting apparatus 9. The controller also synchronizes the speed between the two rolling stands to account for the increase in the length of the clad product due to its reduction in thickness.

As stated above, the inventive method and apparatus wherein a continuously cast material is simultaneously hot worked and clad is adaptable for both known continuous casting and known hot working methods and apparatus. Although hot rolling is disclosed, other hot working means can be utilized to roll bond the liner stock to the cast material at the same time as reducing the cast slab and liner stock thicknesses.

The inventive method and apparatus offers an economical alternative to known methods of cladding ingot material wherein the ingot surface must be first prepared before the cladding takes place.

According to the invention, any material, ferrous or non-ferrous, particularly aluminum or an aluminum alloy, can be effectively hot worked and clad with a liner stock in conjunction with a continuous casting operation. Simultaneously roll bonding the liner stock to the cast material while hot working them takes advantage of the inherent heat in the as cast product exiting the continuous casting apparatus. Thus, the inventive method offers significant savings in energy costs. In addition, conditioning costs typically associated with ingot preparation are eliminated by immediately cladding and hot working the as cast material into a clad stock. The clad stock material is then in form to be further processed as desired, preferably, to a thinner gauge material for use as a brazing sheet.

As such, an invention has been disclosed in terms of preferred embodiments thereof which fulfill each and every one of the objects of the present invention as set forth hereinabove and provides an improved method and apparatus for continuously cladding and hot working cast material.

Of course, various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A method of continuously cladding a belt continuously cast material comprising the steps of:

a) providing a liner stock strip and a belt cast form;

b) positioning said liner stock strip adjacent said belt cast form as it exits a belt casting station at an elevated temperature;

c) applying said liner stock strip to said belt cast form; and d) hot working said cast form with said liner stock strip clad thereto to a select gauge, the inherent heat in the belt cast form as it exits the belt casting station being sufficient to allow hot working and cladding of the cast form.

2. The method of claim 1, wherein said cast form is made of an aluminum or an aluminum alloy.

3. The method of claim 1, wherein said liner stock material is a brazing material.

4. The method of claim 1 further comprising the step of providing a shield at a cladding interface between said liner stock strip and said cast form during said positioning step said shield shielding the interface from impurities present during said hot working step.

5. The method of claim 1, wherein said cast form is a cast slab and said applying and hot working steps reduce said cast slab thickness between 30% and 70%.

6. A clad stock material produced by the method of claim 1.

7. A clad aluminum or aluminum alloy stock material produced by the method of claim 2.

8. A brazing stock material produced by the method of claim 3.

* * * * *